United States Patent [19]

Soininen

[11] Patent Number: 4,887,545

[45] Date of Patent: Dec. 19, 1989

[54] AIR KNIFE

[75] Inventor: Mauri Soininen, Naantali, Finland

[73] Assignee: Valmet Paper Machinery Jylhavaara OY, Valkeakoski, Finland

[21] Appl. No.: 207,648

[22] Filed: Jun. 16, 1988

[51] Int. Cl.[4] ..... B05C 3/12

[52] U.S. Cl. ..... 118/63; 239/553; 239/568; 239/590

[58] Field of Search ..... 239/456, 552, 553, 554, 239/555, 568; 118/62, 63

[56] References Cited

U.S. PATENT DOCUMENTS

| | | | |
|---|---|---|---|
| 2,130,629 | 9/1938 | Clayton | 239/568 |
| 2,801,882 | 8/1957 | Schwemlein | 239/579 |
| 2,928,609 | 3/1960 | Osborne | 239/594 |
| 3,039,696 | 6/1962 | Point et al. | 239/592 |
| 3,690,293 | 9/1972 | Pierson | 118/63 |
| 3,705,457 | 12/1972 | Tardoskegyi | 118/63 |
| 4,062,492 | 12/1977 | Thornton | 118/411 |
| 4,697,542 | 10/1987 | Kohler et al. | 118/63 |

FOREIGN PATENT DOCUMENTS

| | | |
|---|---|---|
| 0151518 | 8/1985 | European Pat. Off. . |
| 1137733 | 12/1968 | United Kingdom . |

*Primary Examiner*—Willard Hoag

*Attorney, Agent, or Firm*—Browdy and Neimark

[57] ABSTRACT

Air knife designed to be used in coating machines or equivalent to finish and smooth the coating by blowing air onto it, e.g. to remove excess coating material, said air knife comprising a main channel into which the air is blown in the axial direction of the channel at least from one direction, the main channel being so constructed that there are two air jets flowing in opposite directions and having equal and constant velocities over the whole length. Thus the air jets discharged from slits next to a partition between the two main channel sections, after being merged, flow in a direction perpendicular to the slit and the air flow is evenly distributed over the whole length of the slit. By using a construction in which the partition is movable, the location of the point at which the two jets mix can be varied, thus allowing the turbulence of the air jet blown at the web to be controlled and, consequently, an influence to be exerted on the properties of the coating surface.

3 Claims, 2 Drawing Sheets

AIR KNIFE

BACKGROUND OF THE INVENTION

The present invention concerns an air knife designed to be used in coating machines or equivalent to finish and smooth the coating by blowing air onto it, e.g. to remove excess coating material, said air knife comprising a main channel into which the air is blown in the axial direction of the channel at least from one direction, the main channel being provided with an air slit of a length essentially equal to the width of the web and directed towards the web to be coated, the air being blasted through said slit onto the web preferably via a nozzle part provided with a nozzle slit, said main channel being provided with a partition dividing the channel into two parts.

An air knife is a device used e.g. in a coating machine to remove the excess coating material from a web of paper or cardboard by means of a sharp jet of air blown at the web surface at a high speed. The air knife is generally placed in the coating or finishing machine in such a way that the air jet meets the web at a certain angle against its running direction, the web being supported from its dry side by a roller placed after the coating station. In this way the impulse of the air jet is transferred to the coating material to be removed and the velocity of the excess material in front of the jet is reduced from the web speed to zero, so that the excess material will then drip off from the web surface.

In addition to removing the extra coating material, it is obvious that the characteristics of the air flow, e.g. turbulence, have an influence on the quality of the remaining surface of the web. For the air knife to have an equal effect over the whole width of the web, the air flow obviously has to be evenly distributed over the whole web width and that the air velocity should have no transverse component relative to the direction of the web.

These requirements are not met adequately by the currently used constructions. The main channel of the air knife, usually extending over the whole width of the web, is of a constant sectional form and the air is supplied into the channel from one or both of its ends. In fact, air supply from both ends means that two nozzle channels are used, each extending over half the width of the web.

Such a construction cannot provide the above-mentioned properties of an ideal air knife. If the main channel has a constant section, the velocity of the air decreases in the channel in the direction of flow of the air and reaches zero at the opposite end of the tube (or at the middle if air is blown in from both ends). Therefore, the static pressure of the air increases in the direction of air flow and, consequently, the air flow is unevenly distributed in such manner that the flow rate is at its lowest at that end where the air enters the channel and at its highest at the opposite end (or, if air is blown in from both ends) at the middle. Moreover, the direction of flow of the air is not exactly the desired direction. Since the impulse acting in the direction of the main channel cannot be lost, the outcoming air flow also has a velocity component transverse to the web direction and equal to the local velocity of the air in the main channel. Thus, the difference between the actual direction and the desired direction of the air flow is largest at that end of the nozzle slit which lies closer to the point of supply of air.

THE OBJECT OF THE INVENTION

The object of the present invention is to eliminate the drawbacks mentioned above. The air knife of the invention is characterized in that the channel parts are of a form that tapers essentially linearly in the direction of air flow, and that a partition divides the slit into two parts in such manner that a slit is formed between the partition and each one of the channel parts. In the air knife of the invention, the air flow is evenly distributed over the whole length of the nozzle slit and the jet air has velocity components only against the running direction of the web and perpendicular to the web surface. Theoretically, no velocity component transverse to the web direction is present.

A preferred embodiment of the invention is characterized in that the jets of air discharged from the two parts of the channel are mixed together in a nozzle part, from where the combined air jet is blown through the nozzle slit onto the web.

Another preferred embodiment of the invention is characterized in that the partition is movable in such manner that the distance between the coating and the partition edge pointing towards the nozzle part is adjustable.

A further preferred embodiment of the invention is characterized in that all the required air is supplied into the main channel via a single air intake at one end of the channel while at the other end there is a space where the air flow passes round the partition so that the direction of flow is changed by 180° relative to the original direction.

BRIEF DESCRIPTION OF THE DRAWINGS

In the following, the invention is described with reference to the drawings attached, wherein.

DETAILED DESCRIPTION OF A PREFERRED EMBODIMENT

The invention is based on the fact that if the main channel of the air knife is so designed that the sectional area of the air flow decreases linearly from the size of the intake opening to zero at the opposite end of the nozzle slit, then the velocity and static pressure of the air (ignoring the negligible frictional losses) are constant through the whole length of the main channel, but the air jet discharged through the slit has a velocity component in the main channel direction over the whole length of the slit. Therefore, such a channel construction eliminates one, but not both, of the drawbacks of the conventional construction.

Figure 2:
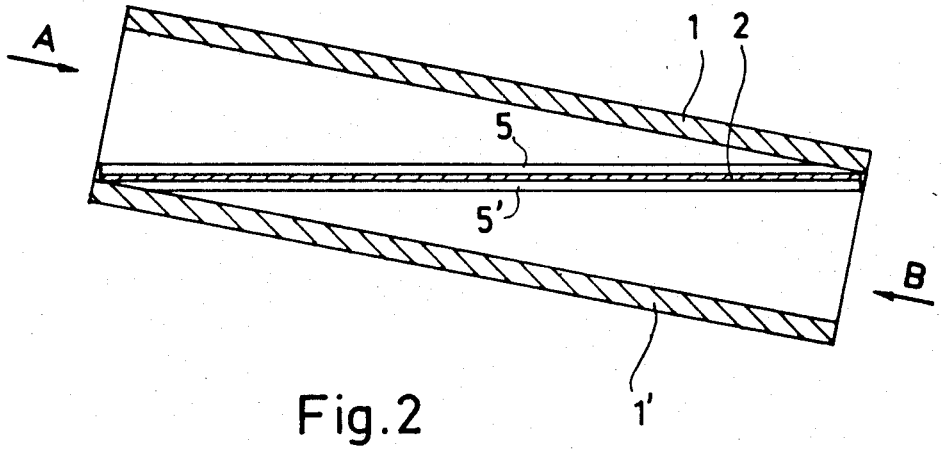
FIG. 2 represents the air knife in FIG. 1 as sectioned along the line II—II.

However, if two main channel parts 1 and 1' constructed as explained in the previous paragraph are placed side by side as shown in FIG. 2, with the nozzle slits 5 and 5' located immediately on each side of the common partition 2 and the air being supplied, as indicated by the arrows A and B in FIG. 2, from opposite ends of the dual channel thus formed, the result is an air knife that exhibits both of the essential characteristics of an ideal air knife.

Since the air flow is evenly distributed in each channel part separately, the same is true for a combination of the two parts.

When an equal amount of air is supplied through each intake and the slits 5 and 5' are of the same width, the longitudinal velocity components of the air jets in the two slits are equal in absolute value but opposite in direction. When the two jets mix, these components will cancel each other and the combined air jet will be exactly perpendicular to the nozzle slit.

Figure 1:
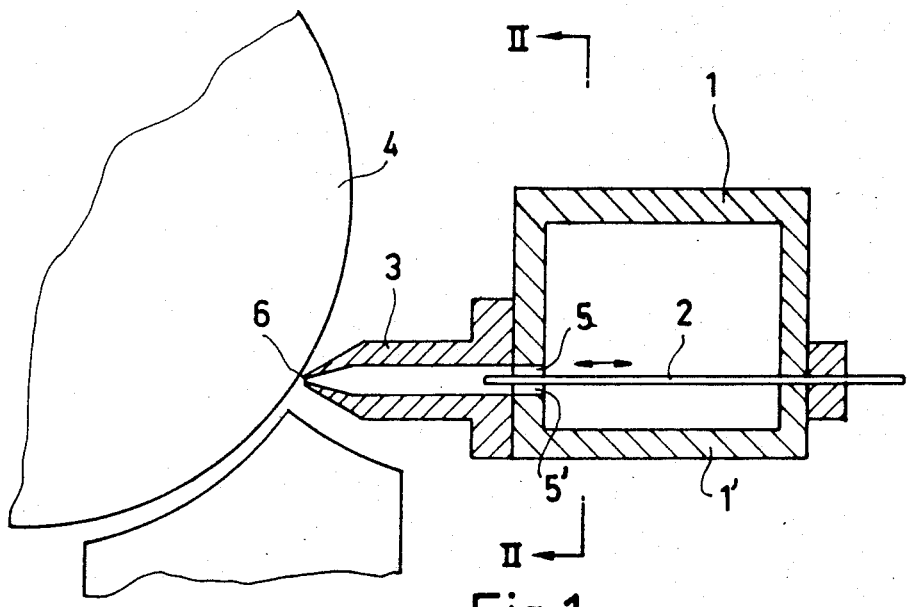
FIG. 1 represents a section through the air knife of the invention.

It is desirable, though not necessary in view of the present invention, that the two jets are allowed to mix in a separate nozzle part 3 as shown in FIG. 1. In view of the flow characteristics, the total width of the slits 5 and 5' should preferably be larger than the nozzle slit 6 through which the air is ultimately discharged at the required, generally very high velocity onto the web on the roller 4.

Although the longitudinal impulses, relative to the slit direction, of the two air jets flowing from the two halves of the main channel cancel each other when the jets mix so that the combined air jet flows in a direction perpendicular to the slit, the impulses of the two fractions of the jet are not lost but instead increase the turbulence of the combined jet. Due to friction, the turbulence is abated (increasing the internal energy of the jet) in proportion to the length of the nozzle part 3 in the direction of air flow before the jet meets the web on the roller 4. By using a construction in which the partition 2 is movable as shown in FIG. 1, the location of the point at which the two jets mix in the nozzle part 3 can be varied, thus allowing the turbulence of the jet of air blown at the web to be controlled. This makes it possible to exert an influence on the properties of the coating surface by regulating the air flow characteristics.

Figure 3:
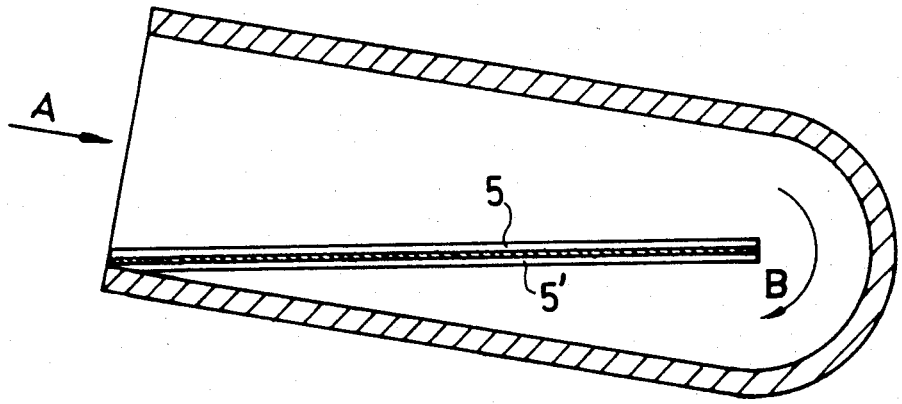
FIG. 3 represents another preferred embodiment of the invention sectioned as in FIG. 2.

FIG. 3 shows a preferred embodiment in which the whole air flow is fed in via one end of the air knife main channel and turned through 180° relative to the original direction at the opposite end.

It is obvious to a person skilled in the art that the invention is not restricted to the examples of embodiments presented in the above description and drawings, but that it may instead be varied in the scope of the following claims. For instance, the main channel may be of an arbitrary sectional form, the partition 2 need not be adjustable, the nozzle part 3 may have e.g. a curved form or it may be omitted, etc.

I claim:

1. An air knife for removing excess coating from a surface of a web, comprising:

wall means defining a main air channel;

first blowing means for blowing air into said main air channel in a first axial direction along said channel;

second blowing means for blowing air into said main channel in a second axial direction along said channel and opposite said first direction a partition dividing said main air channel into first and second axially tapering parts, said first part receiving air blowing in said first axial direction and said second part receiving air blowing in said second axial direction, said first and second parts each axially tapering from widest to narrowest in a downstream direction of said air blowing in said respective part;

an axially extending air slit formed between said partition and said first and second parts of said channel defining means for blasting air from said first and second parts of said channel toward a surface of a web perpendicularly to said first and second axial directions.

2. Air knife according to claim 1, wherein said first and second blowing means comprise means for supplying air into the main channel via a single air intake placed at one axial end of the channel and at another axial end of said channel, a space is provided where the air flows round the partition so that the direction of flow from said first axial direction is changed by 180° to said second axial direction.

3. An air knife according to claim 1, further comprising a nozzle extending perpendicular to said first and second axial directions for receiving said air blasted by said air slit, said nozzle including, at a downstream end thereof, a nozzle slit for directing air from said nozzle onto the surface of the web.

* * * * *